US005898268A

United States Patent [19]

Moreshead et al.

[11] Patent Number: 5,898,268

[45] Date of Patent: Apr. 13, 1999

[54] APPARATUS AND METHOD FOR GENERATING LOW ENERGY ELECTRONS

[75] Inventors: Wylie K. Moreshead, Wylie; Billy B. Hutcheson, McKinney, both of Tex.

[73] Assignee: Texas Instruments Incorporated, Dallas, Tex.

[21] Appl. No.: 08/813,130

[22] Filed: Mar. 7, 1997

[51] Int. Cl.[6] ..... H01J 40/06; H05F 3/00; H05F 3/06

[52] U.S. Cl. ..... 313/542; 313/539; 313/523; 361/212; 361/213

[58] Field of Search ..... 313/523, 539, 313/541, 542, 543, 544; 361/212, 213

[56] References Cited

U.S. PATENT DOCUMENTS 5,621,605 4/1997 Inaba et al. ..... 361/213

*Primary Examiner*—Nimeshkumar D. Patel

*Attorney, Agent, or Firm*—Mark A. Valetti; Carlton H. Hoel; Richard L. Donaldson

[57] ABSTRACT

Apparatus (10, 30, 60) and a method for generating low energy electrons (26, 46) for neutralizing charges (16, 36, 66) accumulated on a wafer (14, 34, 64) is provided. The apparatus includes a photocathode (24, 44, 67) located within a predetermined distance from the wafer (14, 34, 64), and a light source (20, 40, 70, 76, 86) operable to emit a light (22, 42, 72, 78, 88) striking the photocathode (24, 44, 67), the photocathode (24, 44, 67) generating a cloud of low energy electrons (26, 46) with a narrow energy distribution near the wafer (14, 34, 64).

17 Claims, 2 Drawing Sheets

APPARATUS AND METHOD FOR GENERATING LOW ENERGY ELECTRONS

TECHNICAL FIELD OF THE INVENTION

This invention is related in general to the field of semiconductor processing. More particularly, the invention is related to apparatus for generating low energy electrons and a method therefor.

BACKGROUND OF THE INVENTION

During certain semiconductor processing steps, the wafer can become adversely charged as to threaten the integrity of the semiconductor devices being fabricated thereon. For example, in the ion implantation process, a beam of positive impurity ions is accelerated and directed onto the surfaces of semiconductor wafers. The wafers are typically positioned on a spinning wheel so that the wafers are periodically implanted and simultaneously charged by the high energy positive ions. Although the wheel is grounded, it is insufficient to remove all or a substantial portion of the positive charges accumulated on the wafers.

In order to neutralize the charging effect, a number of known apparatus and methods have been developed. One is the electron shower where primary electrons are thermionically emitted from a filament. The primary electrons strike a target which emits secondary electrons toward the wafers. In another known method using thermionic emissions from a filament, the primary electrons strike a target which emits secondary electrons through a gas to create a weak plasma. The weak plasma is the source of electrons that may be drawn toward the wafers to counteract positive charging.

In both electron shower schemes, the high energy primary electrons tend to reach the wafers in excess of the number needed to neutralize the positive charge, thus overcharging the wafers negatively. The primary electrons also tend to charge the surface of the target which causes the secondary electrons emitted therefrom to be charged at the same energy as the charged target. The presence of primary electrons also induces a space charge effect in the path of the electrons which tends to divert the primary electrons from the target. Efforts to filter the primary electrons are complicated and difficult to implement due to the unpredictable nature of the charging effects of the wafers. Therefore, a primary electron filtering scheme must be tailored to each individual ion implantation equipment and process. Further, the filament electron source is fragile and prone to breakage if not handled or operated properly.

A third known method for neutralizing the charged wafers is a plasma flood system which creates a plasma that is contained electrically and magnetically near the wafer. The electrons in the plasma are pulled to the wafer to counteract the positive charges thereon. One problem with the plasma flood system is the complex and sensitive nature of the plasma containment system which is difficult to control to achieve good results. Further, the filament used to generate the electrons in a plasma flood system often experiences reduced operating life due to the introduction of a variety of insulators in the containment system that tend to coat the filament.

SUMMARY OF THE INVENTION

Accordingly, there is a need for an electron source that produces a sufficient number of low energy electrons to counteract the charging effect of wafers during the ion implantation process without generating high energy primary electrons and suffering from adverse effects thereof.

In accordance with the present invention, apparatus and a method for generating low energy electrons are provided which eliminates or substantially reduces the disadvantages associated with prior systems.

In one aspect of the invention, apparatus for generating low energy electrons for neutralizing charges accumulated on a wafer is provided. The apparatus includes a photocathode located within a predetermined distance from the wafer, and a light source operable to emit a light striking the photocathode to generate a cloud of low energy electrons near the wafer.

In another aspect of the invention, a photoelectron source used in semiconductor wafer processing is provided. The photoelectron source includes a photoemissive material, and a light source operable to emit a light striking the photoemissive material, so that the photoemissive material generates a plurality of low energy electrons in response to the light. The plurality of low energy electrons are operable to neutralize a positively charged wafer.

In yet another aspect of the invention, a method for neutralizing the positive charge of wafers includes the steps of generating a light, and directing the light at a photocathode, thereby producing a plurality of low energy electrons having an unobstructed path to the wafers.

A technical advantage of the present invention is the ability to generate sufficient electrons having a tight low energy distribution to neutralize the wafers. The present invention has high reliability due to its simple and elegant solution. Further, the light source is not required to operate in a vacuum, thereby simplifying the construction and operation of the system.

BRIEF DESCRIPTION OF THE DRAWINGS

For a better understanding of the present invention, reference may be made to the accompanying drawings, in which.

DETAILED DESCRIPTION OF THE INVENTION

Figure 1:
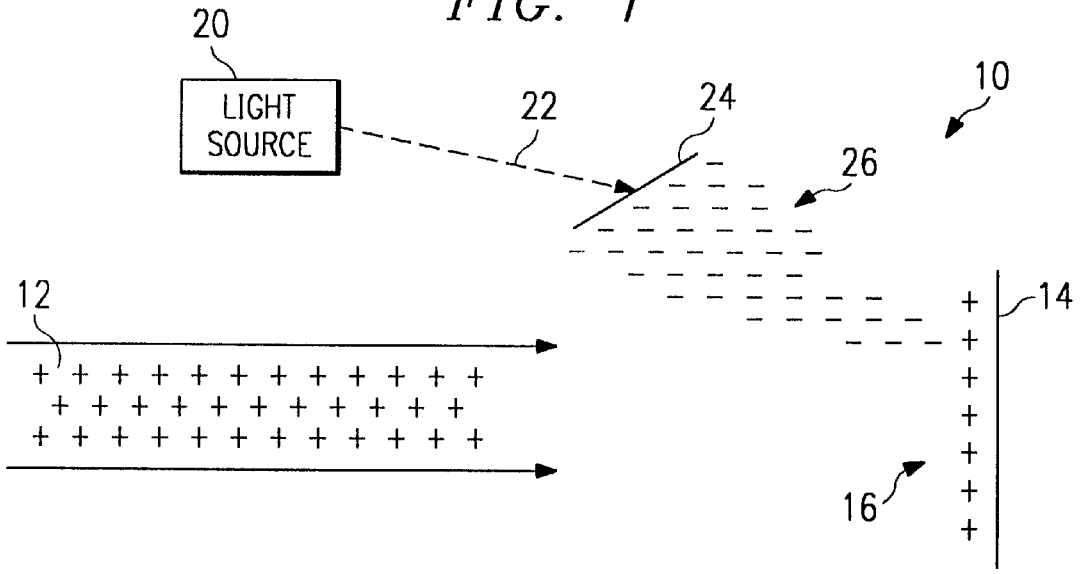
FIG. 1 is a simplified exemplary schematic diagram of an embodiment of apparatus and a method for generating low energy electrons near a wafer according to the teachings of the present invention.

The preferred embodiments of the present invention are illustrated in FIGS. 1–4, like reference numerals being used to refer to like and corresponding parts of the various drawings.

Referring to FIG. 1, a simplified schematic diagram of an exemplary embodiment of apparatus for generating low energy electrons 10 according to the teachings of the present invention is shown. FIG. 1 serves to illustrate the principles of the present invention and the description thereof is applicable to other embodiments set forth below. Apparatus 10 may also be hereinafter referred to as a photoelectron gun or source. In the semiconductor process of ion implantation, a beam 12 of positively charged impurity ions is generated and directed onto the surface of one or more wafers 14. Wafer 14 becomes positively charged by an accumulation of positive charges 16 on its surface. According to the teachings of the present invention, a light source 20 is provided to generate a light or radiation 22, which is directed toward a photocathode 24. Light 22 strikes photocathode 24 and causes an emission of low energy electrons 26 therefrom. In this embodiment, light source 20 is positioned behind photocathode 24 relative to wafer 14, so that a transparent or semitransparent photoemissive material may be used. Electrons 26, because of their low kinetic energy distribution on the order of 1 electron volt, tend to congregate in a region near photocathode 24 with a direct transmission path to wafer 14. As soon as there is an accumulation of positive charges 16 on wafer 14, substantially the same number of low energy electrons 26 are drawn towards wafer 14 to neutralize the positive charge. It is important to note that the distance between photocathode 24 and wafer 14 is such that low energy electrons 26 experience the attraction of positive charges 16 on wafer 14 and are easily drawn toward it. Although not explicitly shown, the present invention is operable to generate a sufficient number of low energy electrons to counteract the charging effect on more than one wafer, which are typically positioned on a spinning wheel (not shown) during the ion implantation process.

It is to be noted that photocathode 24 may be operated in an isolated chamber and exposed to the wafers when the system is at vacuum. However, if photocathode 24 is air-stable, it is not necessary to isolate it when the main ion implant process chamber is open to atmosphere. Additionally, it is not necessary to operate light source 20 in a vacuum so that the construction and operations of system 10 are simplified.

Figure 2:
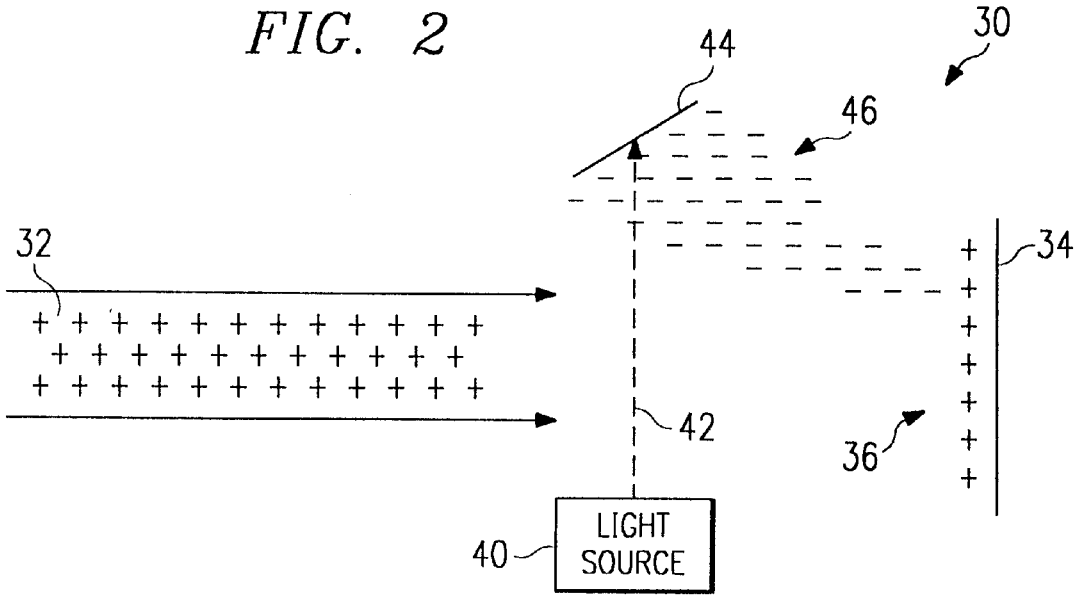
FIG. 2 is a simplified exemplary schematic diagram of another embodiment of apparatus and a method for generating low energy electrons near a wafer according to the teachings of the present invention.

Referring to FIG. 2, an alternate exemplary embodiment of the apparatus for generating low energy electrons 30 is shown. A beam of positive impurity ions 32 is directed toward a wafer 34 for ion implantation. Wafer 34 becomes positively charged with an accumulation of positive ions 36 thereon. A light source 40 is positioned on the same side of a photocathode 44 as wafer 34, so that an opaque or reflective photoemissive material may be used to fabricate photocathode 44. As light 42 strikes photocathode 44, a cloud of low energy electrons is produced. Because of the close proximity of photocathode 44 and wafer 34, the cloud of electrons tends to hang at a distance close enough to wafer 34 as to experience the pull of positive charges 36 thereon. Thus, any positive charge 36 accumulated on wafer 34 serves to attract substantially the same number of electrons 46 to wafer 34, which neutralize the charging effect.

Figure 3:
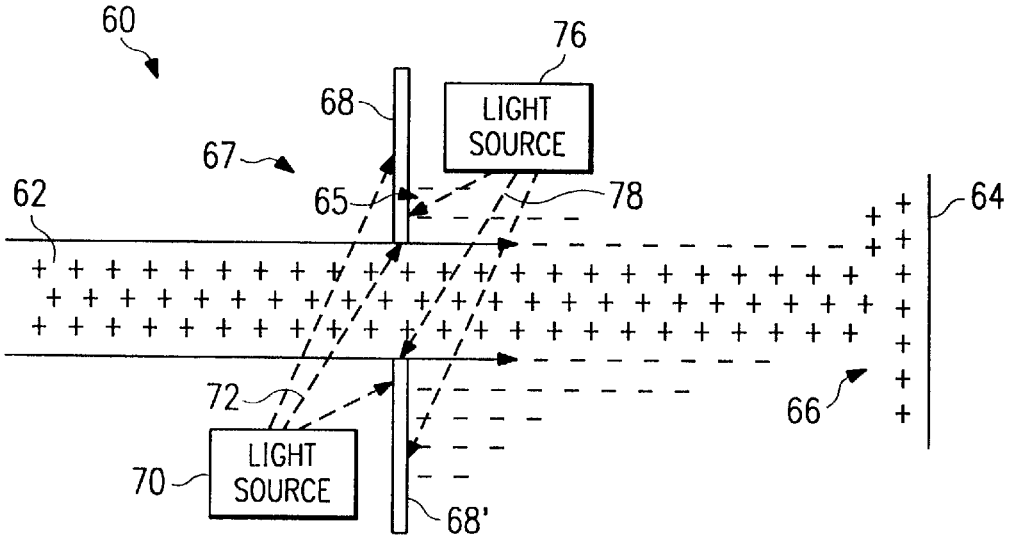
FIG. 3 is a simplified exemplary schematic diagram of yet another embodiment of apparatus and a method for generating low energy electrons near a wafer according to the teachings of the present invention.

FIG. 3 shows another exemplary embodiment 60 of apparatus and method for generating low energy electrons according to the teachings of the present invention. A beam 62 of positively charged impurity ions is directed toward a wafer 64. The ion beam causes the wafer to become positively charged with an accumulation of charge 66 thereon. A photocathode ring 67 defining an inner opening is positioned in the path of ion beam 62. An upper portion 68 and a lower portion 68' of photocathode ring 67 are identified for later reference. Photocathode ring 67 is positioned so that ion beam 62 passes through unobstructedly through its inner opening to reach wafer 64.

Several arrangements of a light source with respect to photocathode ring 67 and wafer 64 are possible according to the teachings of the present invention. A light source 70 may be positioned behind photocathode ring 67 relative to wafer 64 and may direct its light 72 toward photocathode ring 67 constructed of a transparent or semitransparent photoemissive material. Light 72 may also strike the backside of wafer ring 67 including an inner edge of the inner opening to generate low energy electrons in front of ring 67 and/or in the vicinity of the inner opening. Alternatively, a light source 76 may be positioned in front of photocathode ring 67 relative to wafer 64 and may direct its light 78 toward photocathode ring 67 constructed of an opaque or a reflective photoemissive material. Light 78 from light source 76 may also strike the front side of wafer ring 67 including the inner edge of the inner opening as to generate low energy electrons in front of ring 67 and/or in the inner opening.

From the foregoing description, it may be seen that the photocathode is constructed from a photoemissive material. Photoemissive materials emit electrons as a result of bombardment by photons due to photoionization or the photoelectric effect. The photocathodes described above may be constructed from photoemissive materials such as Ag—O—Cs, GaAs(Cs), InGaAs(Cs), Sb—Cs, bialkalis (Sb—Rb—Cs, Sb—K—Cs), high temperature or low noise bialkalis (Na—K—Sb), multialkalis (Na—K—Sb—Cs), Cs—Te, Cs—l, etc., which may be transparent, semitransparent, opaque, or reflective (by using a reflecting substrate). Because photocathode 24 may operate in an environment which experiences varying atmospheric pressures, air stableness is a preferable property of the photoemissive material chosen for this application. Further, the photoemissive material should not produce contaminants that may adversely alter the properties of wafer 14 and devices fabricated thereon. Other factors, such as operating temperature, may also be considered when selecting a photoemissive material.

Figure 4:
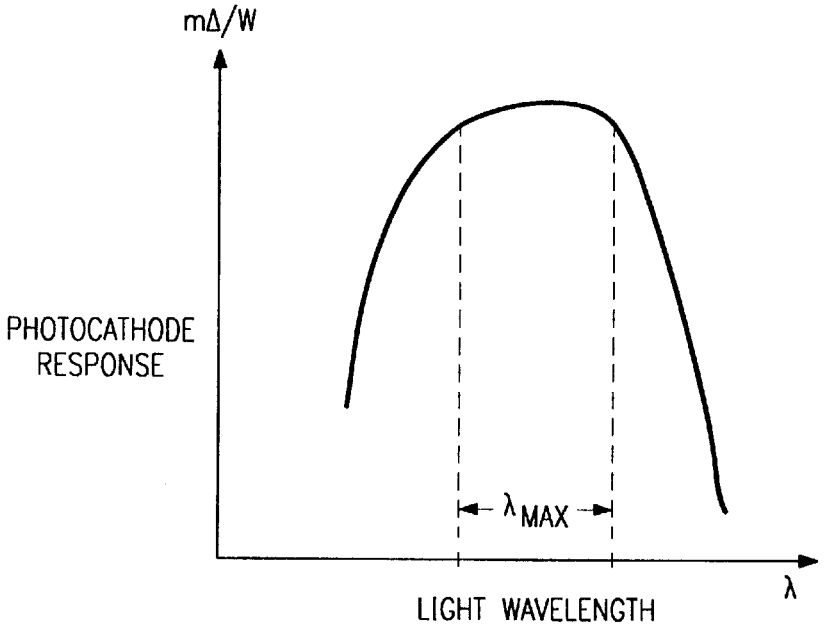
FIG. 4 is an exemplary plot of the spectral response of a photocathode to light having the waveform $\lambda$.

The photoemissive material used to fabricate the photocathode and the wavelength of the incident light may be chosen according to the spectral response of the photocathode. For example, FIG. 4 shows an exemplary plot of the spectral response of a photocathode which is sensitive to an incident light with a wavelength in the region, $\lambda_{MAX}$. A broad range of $\lambda_{MAX}$ indicates that the photocathode is operable with a wider spectrum of light or radiation. The wavelength of the light preferably includes a predetermined range of wavelengths that the photocathode is responsive to. Although the light may be implemented by a laser, it does not have to be a coherent light like a laser. As an example, a GaAs photocathode used in photomultiplier C31034 manufactured by BURLE Industries, Inc. of Lancaster, Pa. is most sensitive to incident light having a wavelength in the 400 to 800 nm range, so that the light chosen should have light components in this wavelength, such as a green laser.

Although several embodiments of the present invention and its advantages have been described in detail, it should be understood that a myriad of mutations, changes, substitutions, transformations, modifications, variations, and alterations can be made therein without departing from the teachings of the present invention, the spirit and scope of the invention being set forth by the appended claims.

What is claimed is:

1. Apparatus for generating low energy electrons for neutralizing charges accumulated on a wafer, comprising:

a photocathode located within a predetermined distance from the wafer;

a light source operable to emit a light striking the photocathode, the photocathode generating a cloud of low energy electrons near the wafer;

and wherein said apparatus for generating low energy electrons is contained within a semiconductor wafer processing chamber.

2. The apparatus, as set forth in claim 1, wherein the light source is operable to generate light having wavelengths within a predetermined range.

3. The apparatus, as set forth in claim 1, wherein the light source is a source operable to produce a laser beam.

4. The apparatus, as set forth in claim 1, wherein the photocathode has a substantially maximum spectral response to the light emitted by the light source.

5. The apparatus, as set forth in claim 1, wherein the cloud of low energy electrons has a narrow energy spectrum.

6. The apparatus, as set forth in claim 1, wherein the photocathode is air stable.

7. The apparatus, as set forth in claim 1, wherein the photocathode generates the cloud of low energy electrons having an unobstructed path to the wafer.

8. The apparatus, as set forth in claim 1, wherein the cloud of low energy electrons are operable to neutralize the wafer when positively charged.

9. The apparatus of claim 1, wherein said semiconductor wafer processing chamber is selected from the group consisting of: an ion implantation processing chamber, a plasma implantation chamber, a plasma etching chamber, or a combination thereof.

10. A photoelectron source used in semiconductor wafer processing, comprising:

a photoemissive material;

a light source operable to emit a light striking the photoemissive material;

the photoemissive material generating a plurality of low energy electrons in response to the light, the plurality of low energy electrons being operable to neutralize a positively charged wafer;

and wherein said photoelectron source is contained within a semiconductor wafer processing chamber.

11. The photoelectron source, as set forth in claim 10, wherein the light source generates a light having a narrow spectrum of wavelengths.

12. The photoelectron source, as set forth in claim 10, wherein the light source generates a laser.

13. The photoelectron source, as set forth in claim 10, wherein the photoemissive material is gallium arsenide.

14. The photoelectron source, as set forth in claim 10, wherein the photoemissive material is a bialkali.

15. The photoelectron source, as set forth in claim 10, wherein the plurality of low energy electrons has an unobstructed path to the positively charged wafer.

16. The photoelectron source, as set forth in claim 10, wherein the photoemissive material is positioned within a predetermined distance from the wafer.

17. The apparatus of claim 10, wherein said semiconductor wafer processing chamber is selected from the group consisting of: an ion implantation processing chamber, a plasma implantation chamber, a plasma etching chamber, or a combination thereof.

* * * * *